US007037163B2

(12) United States Patent
Beard

(10) Patent No.: US 7,037,163 B2
(45) Date of Patent: May 2, 2006

(54) MOTORIZED FLAPPING COSTUME WINGS

(76) Inventor: David Merlin Beard, 3746 Maryland Dr., Doraville, GA (US) 30340

( * ) Notice: Subject to any disclaimer, the term of this patent is extended or adjusted under 35 U.S.C. 154(b) by 410 days.

(21) Appl. No.: 10/405,758

(22) Filed: Aug. 11, 2003

(65) Prior Publication Data

US 2004/0093653 A1 May 20, 2004

Related U.S. Application Data

(60) Provisional application No. 60/369,149, filed on Apr. 2, 2002.

(51) Int. Cl.
*A63H 33/26* (2006.01)

(52) U.S. Cl. ..... 446/28; 2/88

(58) Field of Classification Search ..... 446/26, 446/27, 28; 2/88, 249, 51, 59, 69, 250, 244; 43/3

See application file for complete search history.

(56) References Cited

U.S. PATENT DOCUMENTS

| | | | | |
|---|---|---|---|---|
| 2,810,576 | A * | 10/1957 | Massey | 472/70 |
| 4,268,918 | A * | 5/1981 | Lee | 446/27 |
| 4,660,033 | A * | 4/1987 | Brandt | 2/69 |
| 4,979,921 | A * | 12/1990 | Cardillo | 446/26 |
| 5,417,601 | A * | 5/1995 | Steiger | 446/28 |
| 6,170,188 | B1 * | 1/2001 | Mathews | 43/3 |
| 6,460,284 | B1 * | 10/2002 | Rabo | 43/3 |
| 6,500,041 | B1 * | 12/2002 | Crome, Jr. | 446/27 |
| 6,536,049 | B1 * | 3/2003 | Jastrab et al. | 2/88 |
| 2002/0073476 | A1 * | 6/2002 | Jastrab et al. | 2/88 |

* cited by examiner

*Primary Examiner*—Kien Nguyen

(57) ABSTRACT

Costume wings have existed for decades, having been used for example in the performing arts and worn for special events. Except in cases where they are either moved externally by wires or pneumatic actuators, or by body motions of the wearer, costume wings have been static. In accordance with the present invention, a battery-powered mechanism is attached to costume wings to cause them to move in a flapping motion. The flapping wings may be worn as a unique kinetic fashion accessory or costume.

2 Claims, 7 Drawing Sheets

MOTORIZED FLAPPING COSTUME WINGS

CROSS-REFERENCE TO RELATED APPLICATIONS

This application claims the benefit of Provisional Application No. 60/369,149, filed Apr. 2, 2002.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Costume wings have existed for decades, having been used for example in the performing arts and worn for special events. Except in cases where they are either moved externally by wires or pneumatic actuators, or by body motions of the wearer, costume wings have been static.

BRIEF SUMMARY OF THE INVENTION

In accordance with the present invention, a battery-powered mechanism is attached to costume wings to cause them to move in a flapping motion.

DETAILED DESCRIPTION OF THE INVENTION

In accordance with the present invention, flapping motion of the costume wings is accomplished by attaching a battery-powered mechanism costume wings. The motorized flapping costume wings shown in the accompanying drawings are the popular "angel wings", but the flapping wings concept may be applied to other types of wings, e.g. insect, bird, bat, fairy, dragon, griffin, and demon wings. The flapping wings may be worn as a unique fashion accessory. The wings may look like standard costume wings, or may be fitted with light, fiber optic, glow-in-the-dark, LCD, or other displays or lighting effects to provide a dramatic appearance. Sound effects may accompany the flapping motion to enhance the product. Sound, light, motion, etc. activated switching circuits may be employed to cause the wing drive assembly to respond to various stimuli.

Figure 1:
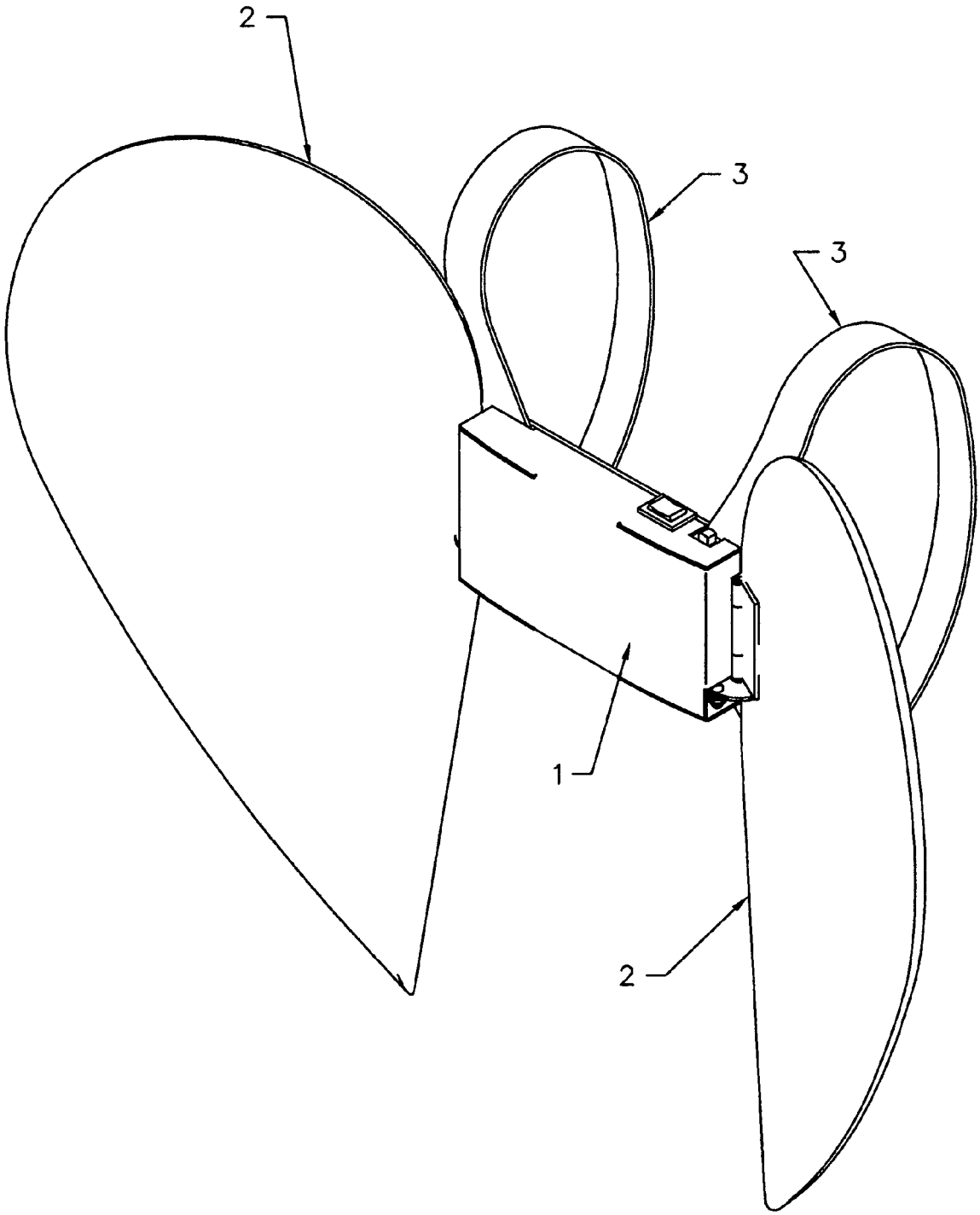
FIG. 1 shows a complete motorized flapping costume wings assembly.
Figure 3:
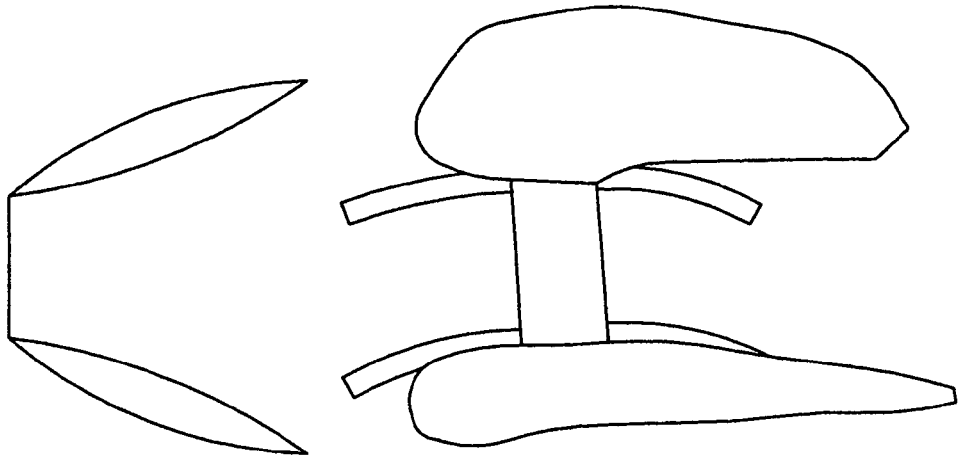
FIG. 3 illustrates the wings' closed positions.
Figure 2:
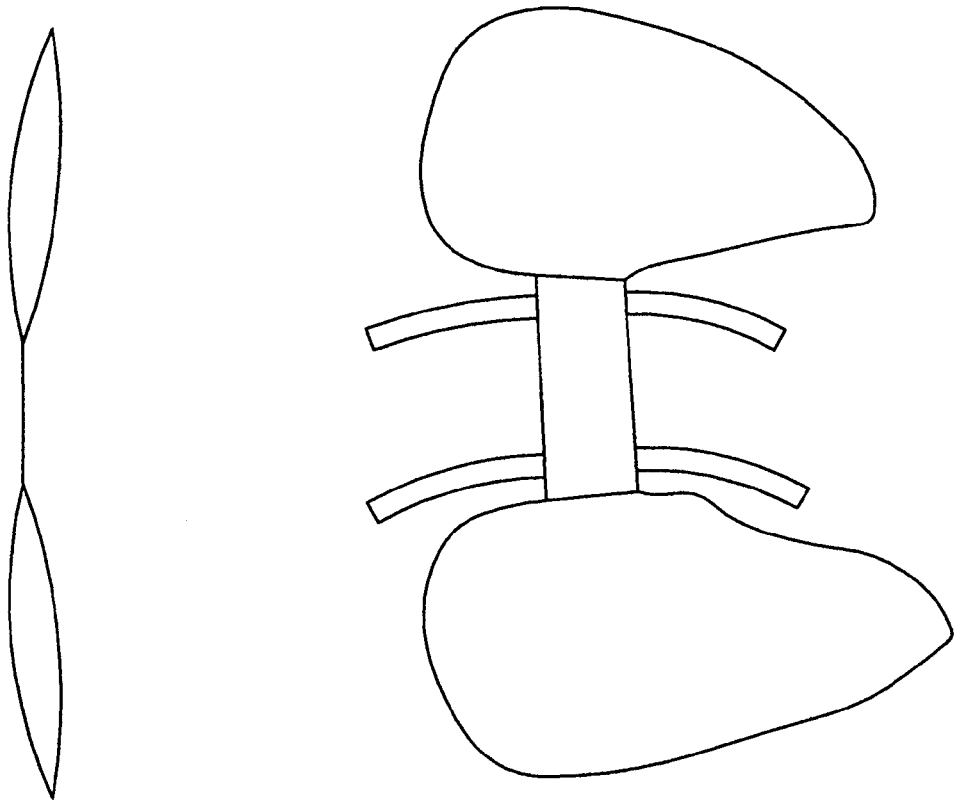
FIG. 2 illustrates the wings' open position.

FIG. 1 shows a complete motorized flapping costume wings assembly, comprising mechanism assembly 1, wings 2, and attachment straps 3. The attachment straps may be elastic straps with snap fasteners or equivalent for adjustability. Elastic straps are one of several possible methods to allow the wings to be worn and affix the motorized flapping costume wings assembly securely to the person wearing the costume. FIGS. 2 and 3 illustrate the wings' open and closed positions, respectively, for a simple application—two wings attached to a base with hinges. When the operating mechanism is activated, the wings cycle from the open or outstretched position to the closed or retracted position and back again to open. More complicated motions are possible by adding mechanisms with servos or motors or equivalent to control wing translations or different axes of rotation along with suitable servo or motor controllers or equivalent.

Figure 4:
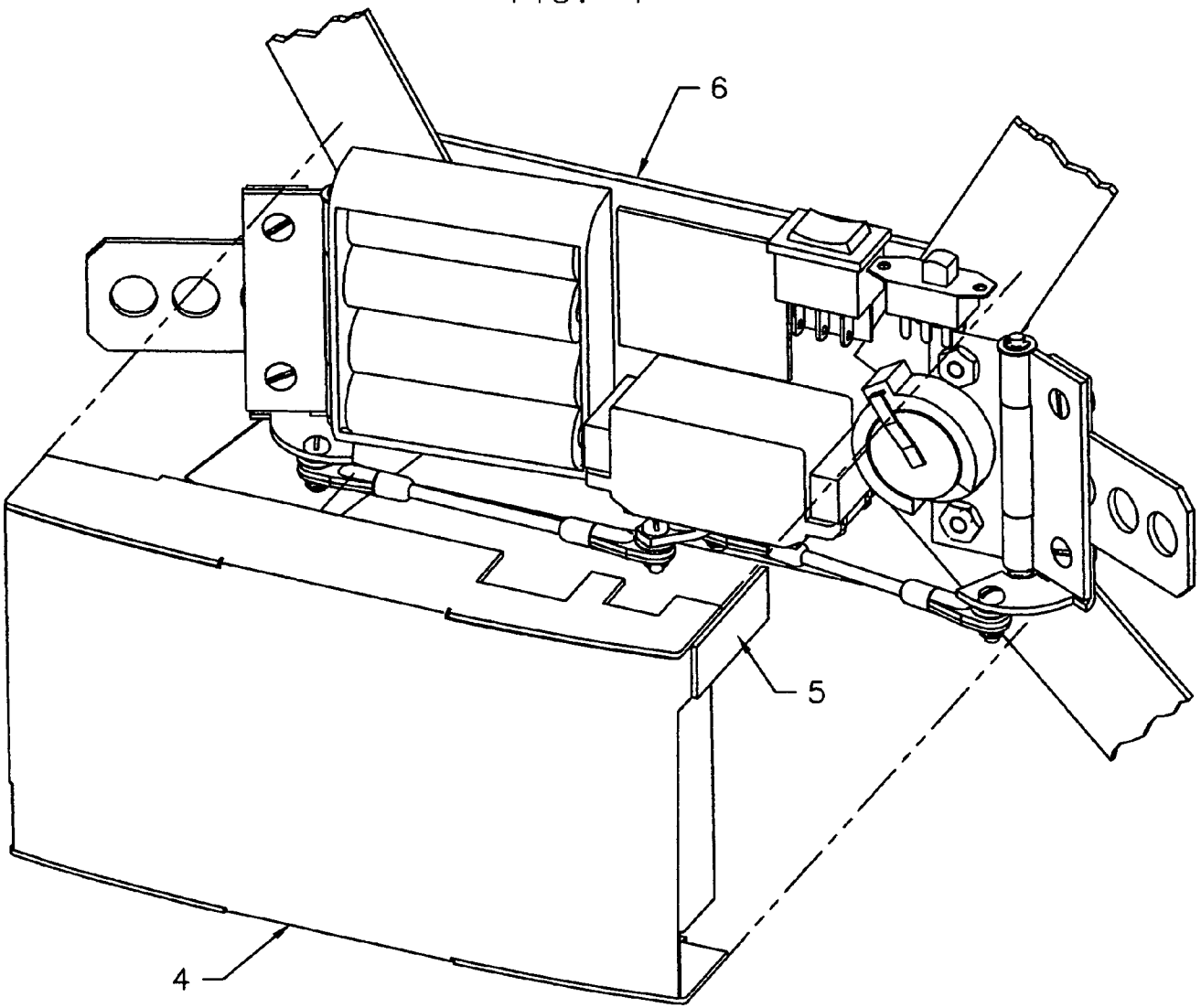
FIG. 4 shows the mechanism assembly with the cover removed from the base.

FIG. 4 shows the mechanism assembly 1 with the cover 4, normally attached with, for example, hook and loop straps 5, to the base 6. Other fasteners or hinge and fastener arrangements may be used to permit the cover 4 to be placed onto or removed from the base 6. FIG. 4 and subsequent figures show the mechanism assembly 1 with the wings 2 removed and attachment straps 3 removed or broken for clarity. The flapping motion for the device shown in FIG. 4 is achieved by using a servo and a servo controller, however other types of motors (perhaps via a cam mechanism) "muscle wire", linear actuator, etc. may be used. FIG. 4 and subsequent figures depict one embodiment of the invention.

Figure 5:
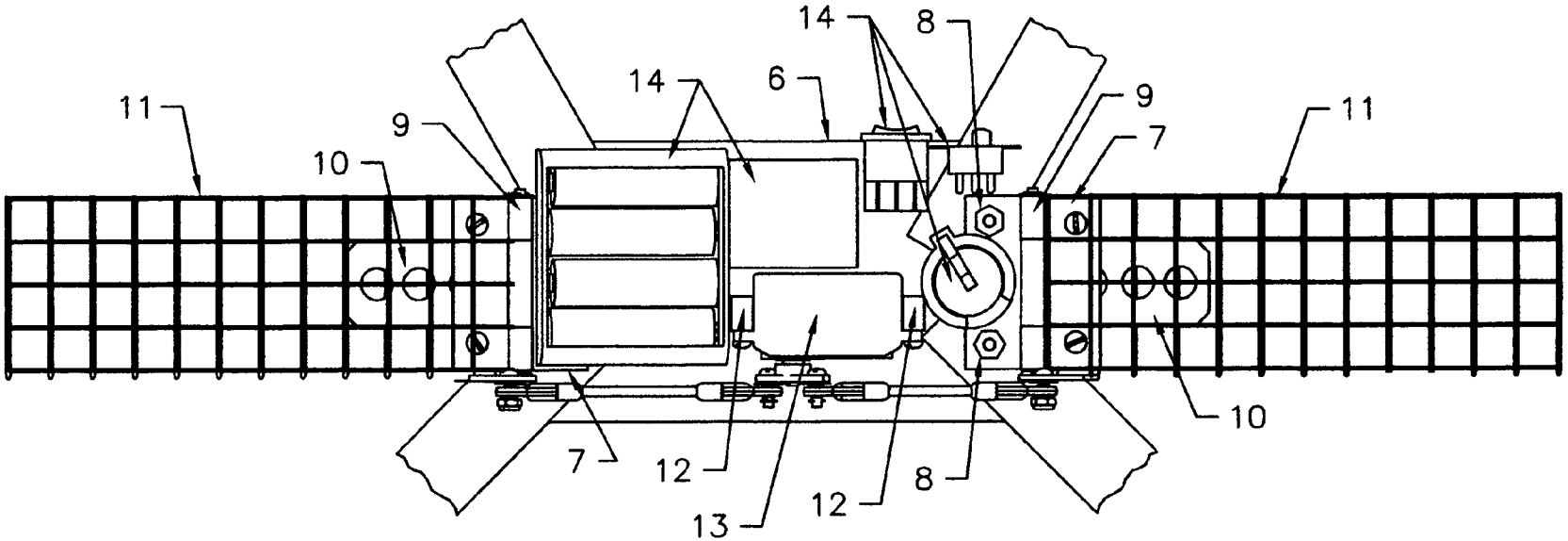
FIG. 5 shows the mechanism assembly with its major components.

FIG. 5 shows the mechanism assembly 1 with its major components. Base hinges 7 are attached to the base 6 with machine screws with nuts 8 or other means. Base hinges 7 may optionally be built into the base 6. Base 6 may be made from plastic sheet or any equivalent material rigid enough to resist significant deflection under the loads imposed on it by the mechanism. Attached to the base hinges 7 are an assembly of wing hinges 9 and brackets 10, here assembled using machine screws with nuts 8. Wing frames 11, made of hardware cloth folded to double it's thickness, are attached to the assembly of wing hinges 9 and brackets 10 with, for example, glue. Wing hinges 9 and brackets 10 are preferably made from steel. The wing frames 11 are attached to wings 2 with, for example, glue, preferably for appearance such that the wing frames 11 are hidden inside wings 2. Servo mounts 12 (plastic) are attached to the base 6 with screws (not shown) through holes in the base 6. The servo 13 is attached to the servo mounts 12 using screws. The servo 13 is a common RC (hobby) servo, it's required torque and speed vary with the size and weight of the wings 2. The circuit 14 (including battery holders, batteries, and switches) is attached to base 6 using glue. The servo 13 is connected to the circuit 14 using a plug-in connector.

Figure 6:
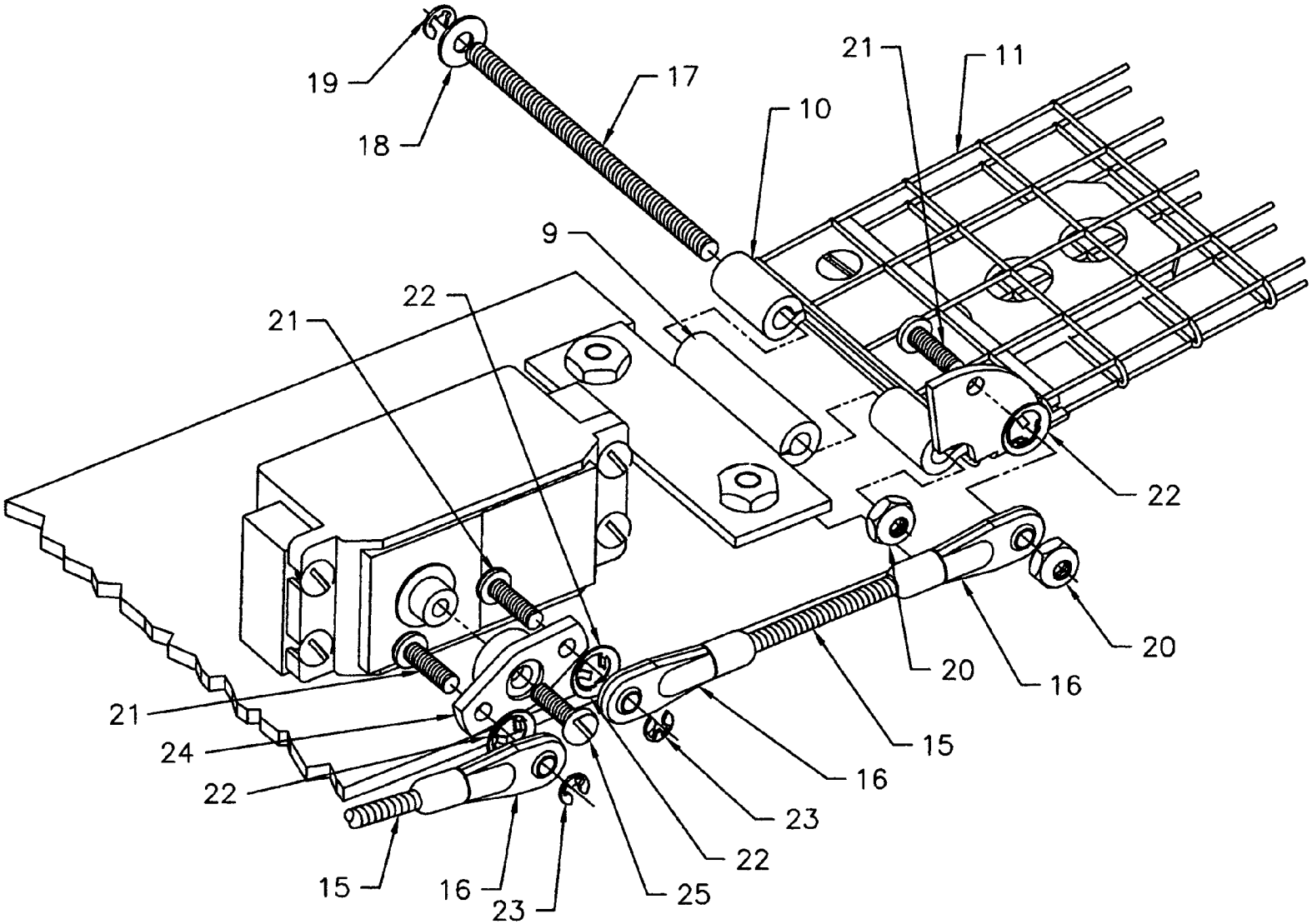
FIG. 6 shows the mechanism assembly detailing the connection of the hinges and the connection of the link assemblies to the brackets and the servo horn.

FIG. 6 shows a partial exploded view of the mechanism assembly with the circuit removed for clarity showing the connection of the base hinges 7 to the assembly of the wing hinges 9, brackets 10, and wing frames 11. Only the right side of the mechanism at the hinge is shown; the left side is a mirror image of the right side. Hinge pins 17, are inserted through base hinges 7 and wing hinges 9 to form a complete hinge, allowing the wing frames 11 and hence the wings 2 to pivot relative to the base 6. Hinge pins 17 may be machine screws; here they are threaded rods and require washer 18 and retaining ring 19 to locate them relative to the wing hinge 9. At the other end of the hinge pins 17 are placed stop nuts 20; stop nuts 20 allow the wings 2 to be removed and reattached by the user, yet keep the stop nuts 20 from vibrating loose during normal operation. Stop nuts 20 should be tightened such that wing hinges 9 may freely pivot about base hinges 7.

FIG. 6 also shows the connection of the link assemblies to the brackets 10 and the servo horn. The link assemblies are assemblies of links 15 and ball-links 16. The links are threaded rod; the ball-links are commercially available assemblies. The ball-links are attached to the brackets 10 using machine screws 21 and nuts or retaining rings 22. Stop nuts 22 hold the ball-links 16 on machine screws 21 such that the ball-links 16 may freely pivot on machine screws 21, yet the stop nuts 22 may be removed and reattached by the user and will not vibrate loose during operation. The ball-links 16 at the opposite end of the links 15 attach to the servo horn 24 using machine screws 21, nuts or retaining rings 22 and retaining rings 23. Nuts or retaining rings 22 keep the machine screws 21 reasonably perpendicular to the servo horn 24 (to reduce undesirable deflections), while stop nuts or retaining rings 23 keep the ball-links 16 on the machine screws 21 such that the ball-links 16 can pivot freely on the machine screws 21. Servo horn 24 is attached to servo 13 using a thread forming screw 25. Note that the since the link assemblies use threaded rod for links 15, the distance between the pivot points of the two pairs of ball-links 16 may be varied by turning one or both of the ball-links about the threaded rod; thus the angles between the wings 2 and the base 6 may be adjusted to appear more symmetric with respect to the base.

Figure 7:
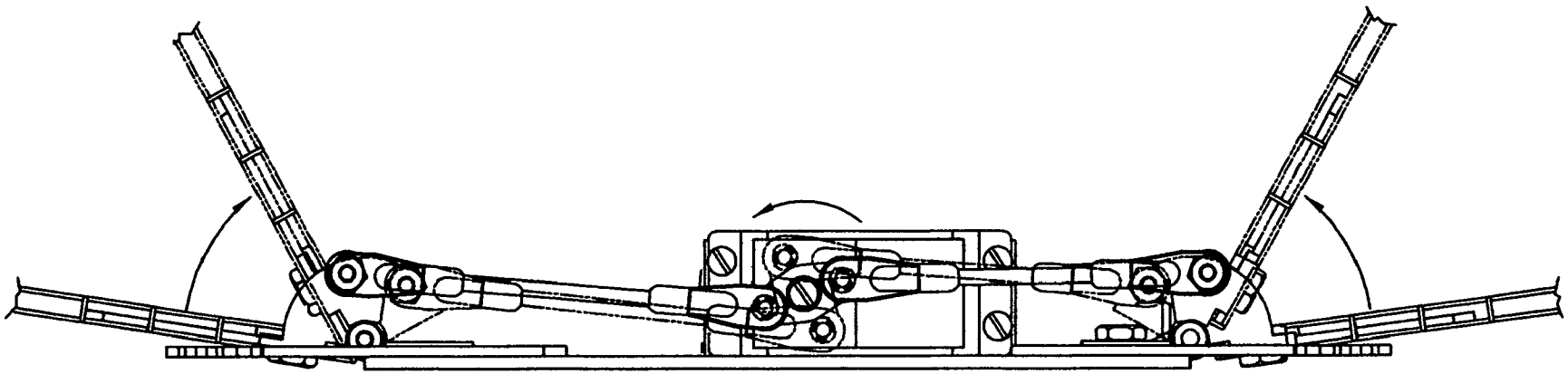
FIG. 7 shows the operation of the mechanism.

FIG. 7 is a view of the mechanism assembly 1 (with some components removed for clarity) showing two positions the mechanism may move to during operation. The base 6, base hinges 7, wing hinges 9, brackets 10, the servo horn 24, and the link assemblies form two four-bar linkages which allow the servo 13 to move the wings 2. As the servo 13 rotates the servo horn 24 in the direction of the arrow, the four-bar linkages move from the configuration shown in solid lines, called the wings open position, to the configuration shown in broken lines, called the wings closed position. The arrows at the wing frames 11 show the direction of motion of the wing frames 11, and hence the wings 2, from the wings open position to the wings closed position. When the circuit 14 is activated in normal mode, the servo 13 drives the wings 2 repeatedly from the wings open position to the wings closed position and back in the direction opposite the arrows to the wings open position to accomplish the desired flapping motion of the wings 2.

Figure 8:
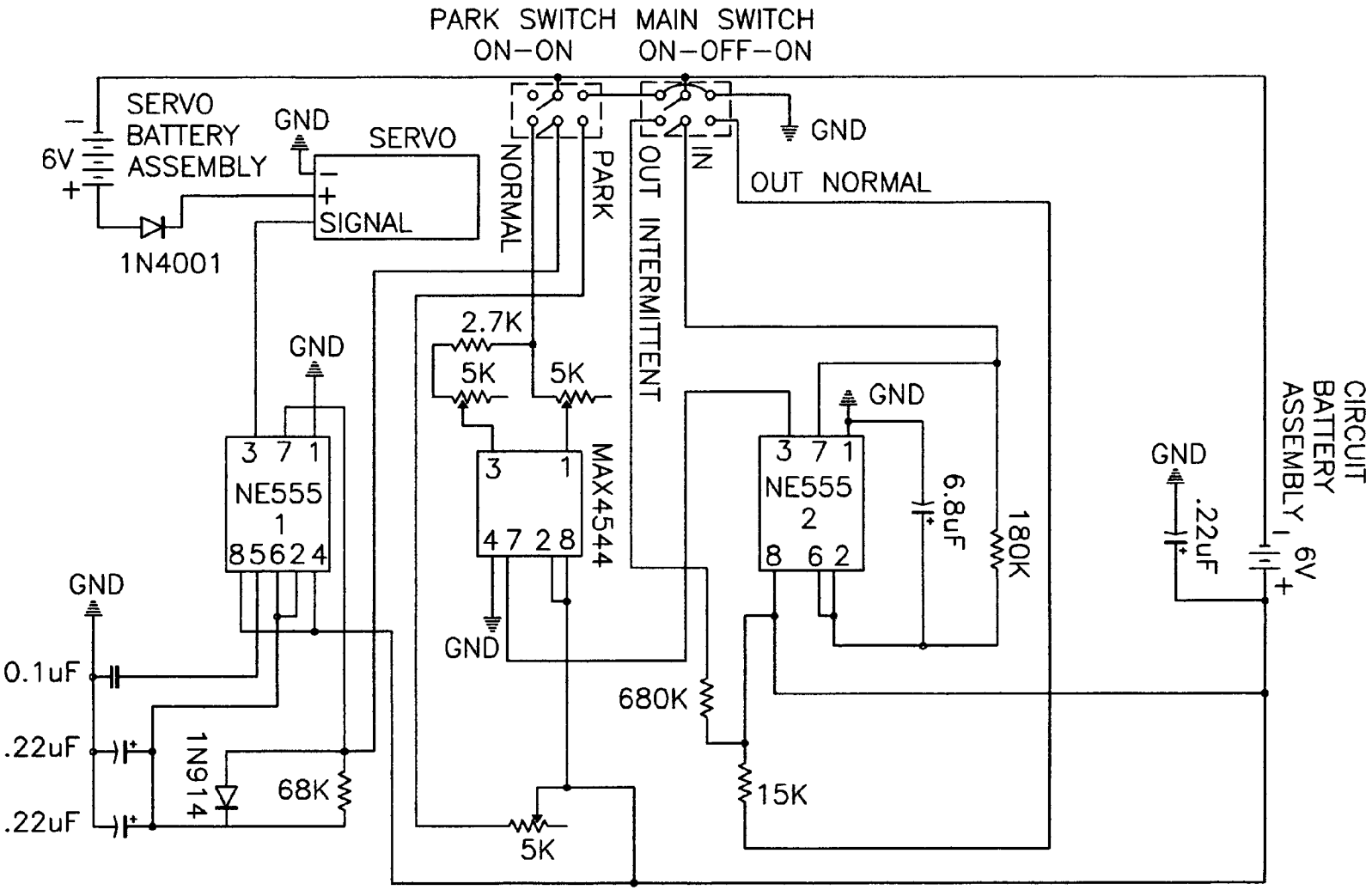
FIG. 8 is a schematic diagram of the servo control and power circuit.

FIG. 8 is a schematic diagram of a circuit that will drive the servo 13 to accomplish the desired motion of the mechanism. Other circuits may be substituted, including custom or commercially available programmable servo controllers. Much literature is available describing circuits using an NE555 timer or equivalent to control servo position; this description contains information relating to circuit characteristics unique to the present invention. When the main switch is moved to one of the on positions, power is supplied to the circuit. The NE555 timer labeled NE555 2 is connected so that it runs in astable operation mode, producing alternatively a voltage high signal then a low signal at pin 3 of NE555 2. The output signal at pin 3 of NE555 2 is connected to the control pin 7 of the analog switch labeled MAX4554. When the output at pin 3 of NE555 2 is voltage low, the nominal +6V at MAX4554 pin 2 is routed through MAX4554 pin 1; when the output at pin 3 of NE555 2 is voltage high, the nominal +6V at MAX4554 pin 2 is routed through MAX4554 pin 3. MAX4554 pins 1 and 3 connect to the NE555 timer labeled NE555 1 at pin 7 when the park switch is in the normal position. NE555 1 also is connected so that it runs in astable operation mode. The paths from MAX4554 pin 1 and NE555 1 pin 7 and from MAX4554 pin 3 and NE555 1 pin 7 have different resistances, so the voltage supplied to NE555 1 pin 7 oscillates between two voltage values at a frequency determined by NE555 2. The values of the voltage at NE555 1 pin 7 determines the duration of the pulse at NE555 1 pin 3, which is connected to the servo "signal in" lead.

The durations of the high and low voltage signals output at NE555 2 pin 3 depend on the position of the main switch. In this circuit, when the main switch is in position normal, the duration of both the voltage high signal and the voltage low signal is about 0.8 seconds. When the main switch is in position intermittent, the duration of the voltage high signal is about 0.8 seconds, and the duration of the voltage low signal is about 3.2 seconds. Hence the user can change the flapping motion of the wings from normal mode (constant flapping) to intermittent flapping mode by changing the position of the main switch.

With the main switch in either the on position or the off position, moving the park switch to the park position supplies power to the circuit (if the main switch is in the off position) and allows the circuit to bypass NE555 2 and MAX4454. A constant voltage is supplied to NE555 1 pin 7, causing NE555 1 to output a constant duration pulse. This pulse commands the servo to move to and hold a position called the park position, which holds the wings 2 in a closed position. Hence the user can cause the wings to stay in the closed position by changing the position of the park switch from normal to park.

The circuit shown in FIG. 8 uses two standard switches to control wing motion. Remote control switches can also be used to accomplish the switching on and off and between modes.

I claim:

1. A costume or fashion accessory to be worn on the wearer's back, comprising:

a) one or more movable wings;

b) one or more motorized mechanisms to which the wings are attached and which moves the wings in such a motion as to simulate flapping;

c) one or more electric or electronic circuits including power supplies and switches as required to drive the motorized mechanisms to obtain the desired wing motion;

d) means for attaching the costume to and removing the costume from the wearer.

2. The costume or fashion accessory as in claim 1 which said wing motion is remotely controlled by wireless control.

* * * * *